US012104380B2

(12) United States Patent
Johnson et al.

(10) Patent No.: US 12,104,380 B2
(45) **Date of Patent: *Oct. 1, 2024**

(54) PERMEABLE WATER-RESISTIVE SLOPED ROOF UNDERLAYMENT/AIR BARRIER

(71) Applicant: VAPROSHEILD LLC, Gig Harbor, WA (US)

(72) Inventors: Philip L. Johnson, Spring Lake, MI (US); Kevin D. Nolan, Seattle, WA (US); Daniel Bess, Newbury, OH (US); Adrian DeKrom, Cardon, OH (US)

(73) Assignee: VaproShield LLC, Gig Harbor, WA (US)

( * ) Notice: Subject to any disclaimer, the term of this patent is extended or adjusted under 35 U.S.C. 154(b) by 92 days.

This patent is subject to a terminal disclaimer.

(21) Appl. No.: 18/050,337

(22) Filed: Oct. 27, 2022

(65) Prior Publication Data

US 2023/0175266 A1 Jun. 8, 2023

Related U.S. Application Data

(63) Continuation of application No. 16/602,852, filed on Dec. 13, 2019, now Pat. No. 11,512,473.

(60) Provisional application No. 62/917,517, filed on Dec. 13, 2018.

(51) Int. Cl.
*E04D 12/00* (2006.01)
*E04B 1/62* (2006.01)

(52) U.S. Cl.
CPC ..... *E04D 12/002* (2013.01); *E04B 1/625* (2013.01)

(58) Field of Classification Search
None
See application file for complete search history.

(56) References Cited

U.S. PATENT DOCUMENTS

| | | | |
|---|---|---|---|
| 2,140,026 | A | 12/1938 | Edward |
| 3,440,185 | A | 4/1969 | Hanley |
| 3,445,272 | A | 5/1969 | Newton, Jr. |
| 3,539,388 | A | 11/1970 | Shu-Tung |
| 3,979,867 | A | 9/1976 | Sowinski |
| 4,098,044 | A | 7/1978 | Slavik |
| 4,163,822 | A | 8/1979 | Walter |
| 4,252,590 | A | 2/1981 | Rasen et al. |
| 4,315,392 | A | 2/1982 | Sylvest |

(Continued)

FOREIGN PATENT DOCUMENTS

| | | |
|---|---|---|
| CA | 2843707 | 2/2017 |
| CA | 2887478 | 1/2018 |

(Continued)

OTHER PUBLICATIONS

British Board of Agreement, Tyvek (R) Supro Roof Tile Underlayment for Use in Warm Non-Ventilated and Cold Ventilated Roofs, Certificate No. 08/4548, Apr. 8, 2008.

(Continued)

*Primary Examiner* — Jacob T Minskey
*Assistant Examiner* — Adrianna N Konves
(74) *Attorney, Agent, or Firm* — Janeway Patent Law PLLC; John Janeway

(57) ABSTRACT

A water resistant, UV resistant, vapor permeable, air barrier roofing underlayment assembly for use on roofs comprising a substrate of permeable polyester, a permeable copolymer acrylate coating bonded to the permeable polyester substrate and a pressure sensitive permeable copolymer adhesive secured to the permeable acrylate coating.

11 Claims, 2 Drawing Sheets

(56) References Cited

U.S. PATENT DOCUMENTS

| | | | |
|---|---|---|---|
| 4,655,210 | A | 4/1987 | Edenbaum |
| 4,764,412 | A | 8/1988 | Burns |
| 4,815,963 | A | 3/1989 | Berkhout |
| 4,851,272 | A | 7/1989 | Knox, III |
| 5,099,627 | A | 3/1992 | Coulton et al. |
| 5,425,672 | A | 6/1995 | Rotter |
| 5,598,673 | A | 2/1997 | Atkins |
| 5,617,687 | A | 4/1997 | Bussey, Jr. |
| 5,709,651 | A | 1/1998 | Ward |
| 5,960,595 | A | 10/1999 | McCorsley, III et al. |
| 5,973,015 | A | 10/1999 | Coronado et al. |
| 5,993,927 | A | 11/1999 | Sugita et al. |
| 6,131,353 | A | 10/2000 | Egan |
| 6,284,368 | B2 | 9/2001 | Muta |
| 6,316,016 | B1 | 11/2001 | Iwakawa |
| 6,594,965 | B2 | 7/2003 | Coulton |
| 6,804,922 | B1 | 10/2004 | Egan |
| 6,927,267 | B1 | 8/2005 | Varela de la Rosa |
| 6,938,383 | B2 | 9/2005 | Morris et al. |
| 7,117,649 | B2 | 10/2006 | Morris et al. |
| RE39,825 | E | 9/2007 | Morris et al. |
| 7,488,523 | B1 | 2/2009 | Muncaster |
| 7,617,638 | B1 | 11/2009 | Slama et al. |
| 7,651,757 | B2 | 1/2010 | Jones et al. |
| 8,146,310 | B2 | 4/2012 | Keene |
| 8,245,472 | B2 | 8/2012 | Keene |
| 8,387,336 | B2 | 3/2013 | Coulton |
| 8,549,806 | B2 | 10/2013 | Snyder |
| 8,590,267 | B2 | 11/2013 | Jaffee |
| 9,249,060 | B2 | 2/2016 | Herold |
| 9,286,577 | B2 | 3/2016 | Shofner et al. |
| 9,453,337 | B2 | 9/2016 | Fritz |
| 9,783,980 | B2 | 10/2017 | Snyder et al. |
| 10,125,489 | B2 | 11/2018 | Snyder |
| 2002/0037956 | A1 | 3/2002 | Avramidis |
| 2002/0146953 | A1 | 10/2002 | Lubker, II |
| 2003/0232171 | A1 | 2/2003 | Keith |
| 2004/0106346 | A1 | 6/2004 | Zafiroglu |
| 2004/0180195 | A1 | 9/2004 | Macuga |
| 2004/0237464 | A1 | 12/2004 | Khan |
| 2005/0000172 | A1 | 1/2005 | Anderson |
| 2005/0014431 | A1 | 1/2005 | Carmody et al. |
| 2005/0055983 | A1 | 3/2005 | Tomes |
| 2005/0214496 | A1 | 9/2005 | Borenstein |
| 2006/0096218 | A1 | 5/2006 | Johnson |
| 2006/0101758 | A1 | 5/2006 | Egan |
| 2006/0211781 | A1 | 9/2006 | Strandburg |
| 2007/0212520 | A1 | 9/2007 | Furumori et al. |
| 2008/0120935 | A1 | 5/2008 | Lembo |
| 2008/0268224 | A1 | 10/2008 | Kim |
| 2009/0047465 | A1 | 2/2009 | Zafiroglu |
| 2009/0288358 | A1 | 11/2009 | Snyder |
| 2011/0185666 | A1 | 8/2011 | Russell |
| 2011/0312240 | A1 | 12/2011 | Amthor |
| 2012/0244340 | A1 | 9/2012 | Peng |
| 2013/0052401 | A1 | 2/2013 | Snyder |
| 2015/0024159 | A1 | 1/2015 | Bess et al. |
| 2015/0136207 | A1 | 5/2015 | Giron |
| 2015/0307751 | A1 | 10/2015 | Eckhardt |
| 2016/0024782 | A1 | 1/2016 | Bess et al. |
| 2017/0044404 | A1 | 2/2017 | Yamamoto et al. |
| 2017/0174952 | A1 | 6/2017 | Bess et al. |
| 2018/0237662 | A1 | 8/2018 | Widenbrant |

FOREIGN PATENT DOCUMENTS

| | | |
|---|---|---|
| CA | 2887481 | 1/2018 |
| EP | 0397554 | 8/1994 |
| EP | 0874099 | 2/2001 |
| FI | 116226 | 10/2005 |
| GB | 2473618 | 3/2011 |
| JP | H7-138539 | 5/1995 |
| JP | 2001003025 | 1/2001 |
| JP | 07048554 | 5/2022 |
| WO | 200220246 | 3/2002 |
| WO | 2006047130 | 11/2006 |
| WO | 2008067611 | 6/2008 |
| WO | 2009127819 | 10/2009 |
| WO | 2010056372 | 5/2010 |

OTHER PUBLICATIONS

Derwent Abstract of JP 2001-3025.

Cosella-Dorken Products, Inc. Technical Data Sheet for Delta (R)—Fassade S and Delta (R)—Fassade S Plus UV, Dec. 21, 2011.

Cosella-Dorken Products, Inc. Technical Data Sheet for Delta (R)—Vent S.

E.I. du Pont De Nemours and Company, "DuPont Tyvek(R) Providing Protection in Construction".

Irish Agreement Board, "DuPont Tyvek(R) Supro Vapour Permeable Roofing Underlays for Pitched Roofs", Certificate No. 04/0157, Nov. 2004.

PERMEABLE WATER-RESISTIVE SLOPED ROOF UNDERLAYMENT/AIR BARRIER

RELATED APPLICATIONS

The present application is a continuation application of commonly owned, and currently pending, U.S. Utility patent application Ser. No. 16/602,852 filed 13 Dec. 2019 and titled "Permeable Water-Resistive Sloped Roof Underlayment/Air Barrier", which claims priority from, and incorporates by reference, U.S. Provisional Patent Application 62/917,517 filed 13 Dec. 2018 and titled "Permeable Water-Resistive Sloped Roof Underlayment/Air Barrier". This continuation application claims priority from both U.S. Utility patent application Ser. No. 16/602,852 and U.S. Provisional Patent Application 62/917,517, and incorporates by this reference all that each of these applications teaches and discloses.

STATEMENT REGARDING FEDERALLY SPONSORED RESEARCH OR DEVELOPMENT

None

REFERENCE TO SEQUENCE LISTING. A TABLE OR A COMPUTER PROGRAM LISTING COMPACT DISC APPENDIX

None.

BACKGROUND OF THE INVENTION

1. Field of Invention

The present invention relates to a building material membrane, and more particularly to a non-asphaltic roof underlayment that is vapor permeable, forms an air barrier, and is resistant to water and ultra-violet (UV) light. The underlayment can be a component of a roof assembly on medium to high pitched sloped roofs.

2. Background of the Invention

In the roofing industry, a roofing underlayment is typically applied to a medium to high pitched sloped roof to form a vapor and air barrier over which insulation and a roof cover is applied. A primary goal of this kind of underlayment is to stop vapor and water entry. However, in a number of applications for sloped roofs having 9.45°/2:12 inch slope or greater slope, it is preferable to stop air infiltration and allow water vapor dispersion. The present invention is directed toward the latter application.

It is known in the prior art that sloped roofs are often covered with metal, tile or slate. In steep slope roofing, typically defined as a roof with a greater slope than 2:12 inches of fall, the primary goal of the underlayment is to provide a defense to water entry. Common among the membranes that have the mechanical properties needed to be technologically useful are underlayments such as SBS rubberized asphalt, bitumen asphalt materials or non-permeable polypropylene synthetics.

Other common problems that occur are underlayment blowing off due to wind or deterioration because of UV degradation.

Currently, all of the commercial asphaltic and non-asphaltic underlayments tend to be water-resistant but substantially non-breathable or with little or no permeability. That is, both asphaltic and non-asphaltic underlayments do not allow water vapor to pass through it. As a result, the moisture from the interior of the roofing assembly is trapped in the roof composite that may or may not have insulation and is unable to escape to the exterior atmosphere resulting in damage to the roof assembly over the life of the building. Furthermore, asphaltic membranes can degrade due to UV radiation from the sun and weather conditions prior to installation of the final roofing.

U.S. Pat. No. 4,511,619 issued Apr. 16, 1985 discloses a sealing sheet for the building industry made up of at least one layer that contains filler such as carbon black mixed with an ethylene-propylene copolymer which has a reinforcing laminate in place. The reinforcing layer can be formed of a fabric, a mat, a knitted material, a non-woven material, a synthetic resin or a glass fiber.

U.S. Patent Application Publication Number 2014/0072751 published Mar. 13, 2014 discloses a single-ply polymer coated substrate with at least one adhesive layer for structural water proofing.

U.S. Pat. No. 8,309,211 issued Nov. 13, 2012 discloses a roofing underlayment substrate that is permeable transmitting water vapor at a minimum of 3 perms, water resistant and skid-resistant. The roofing underlayment includes a woven or non-woven substrate having at least one surface which includes a breathable thermoplastic film which also imparts water-resistant to the substrate.

None of the aforementioned references appear to be permeable to allow meaningful transmission of water vapor or are designed to be UV resistant or attempt to prevent or preclude build up of water vapor and the resultant mold, mildew, rot from forming in the roof assembly. The prior art teachings noted above do not aid in the resolution of a number of practical difficulties that are resolved by the present invention.

Most current research in building envelope design has confirmed that the highest possible dry characteristics/permeability of a membrane help to eliminate or allow escape of damaging water vapor within the building envelope. This dry effect of high permeance and the fact that the product is an air barrier allow for energy savings and offer the desired product characteristics that do not presently exist together in the roofing membrane industry.

In view of the drawbacks mentioned above with prior art underlayments, there is a need for providing a non-asphaltic self adhering roofing underlayment that is a breathable air barrier thereby allowing moisture in the form of water vapor to escape from inside the roof assembly, while preventing water vapor moisture from destroying the roofing composite of insulation and structural deck. Furthermore a roof underlayment having durability for foot traffic during construction and UV-resistance is a highly desirable property of an underlayment.

SUMMARY OF THE INVENTION

The present invention is directed towards a sloped roofing self-adhering underlayment that is water resistive, UV resistant and a vapor permeable air barrier. The present roofing to underlayment is a polyester substrate which is coated with a foamed n-butyl acrylate copolymer containing carbon black and separate pressure sensitive adhesive coating which is heated and cured to maintain air bubble pores in place. The permeable pressure sensitive copolymer adhesive coating having a back bone of n-butyl acrylate, 2-ethylhexyl acrylate and vinyl acetate is foamed and coated over the n-butyl acrylate copolymer coating, bonding to the coating with a reduction in tackiness in the adhesive which may eliminate the need for a slip sheet in some usages. After curing, the pressure sensitive adhesive, back coating and substrate is laminated.

In one particular embodiment, the permeable polyester substrate has a permeable acrylate coating on the back side of the base substrate and a permeable pressure sensitive adhesive is applied over the acrylate coating.

BRIEF DESCRIPTION OF THE DRAWINGS

The present invention will be described with reference to the appended Figures, in which.

These and other objects, advantages, and novel features of the present invention will become apparent when considered with the teachings contained in the detailed disclosure along with the accompanying drawings.

DESCRIPTION OF THE INVENTION

Figure 1:
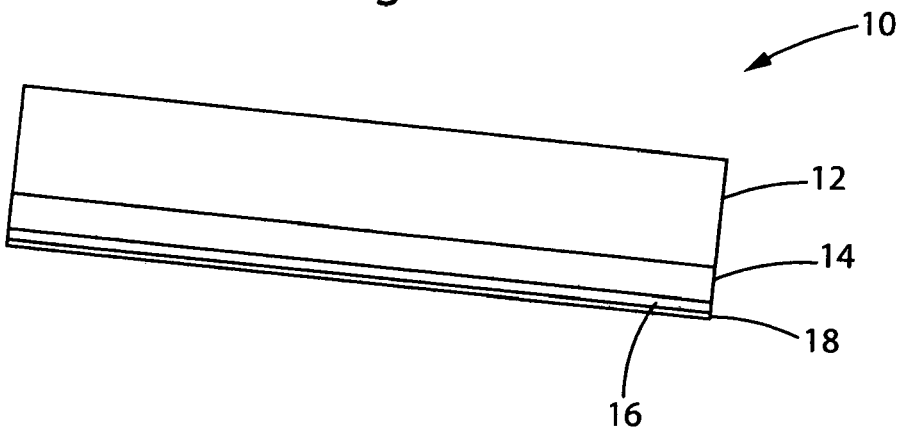
FIG. 1 is a schematic enlarged cross sectional view of the inventive underlayment used on a typical sloped roof construction with metal roofing and rigid insulation.
Figure 2:
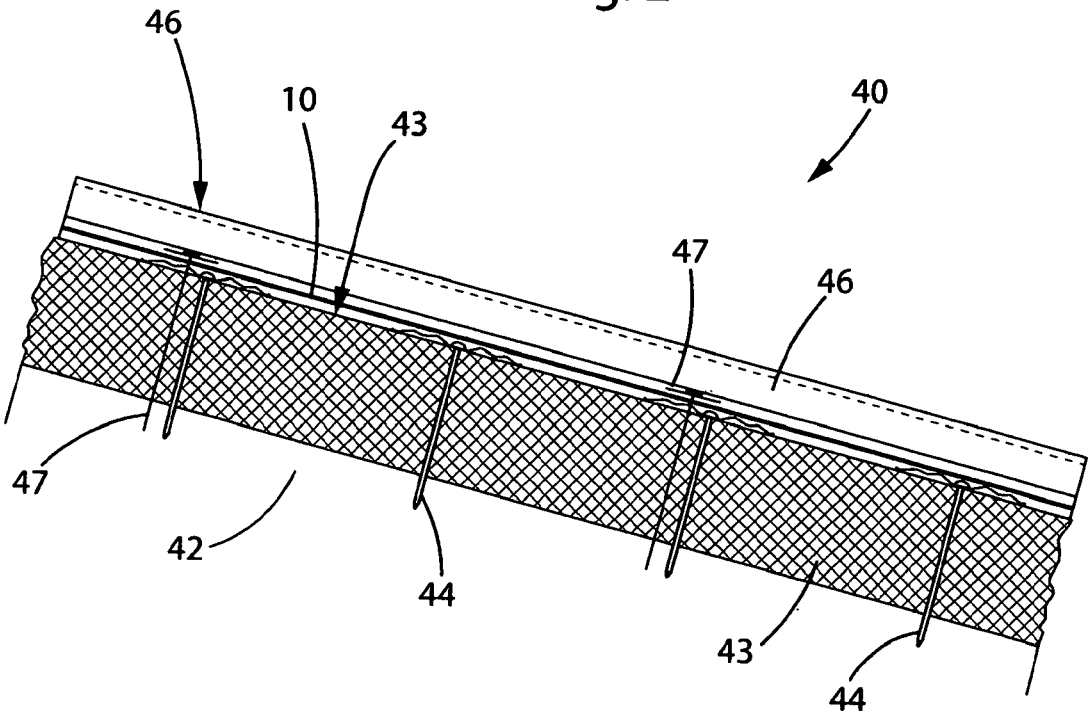
FIG. 2 is a schematic cross section view of a sloped roof system with the inventive underlayment being used under a metal roof placed over a filled rock wool insulation.
Figure 3:
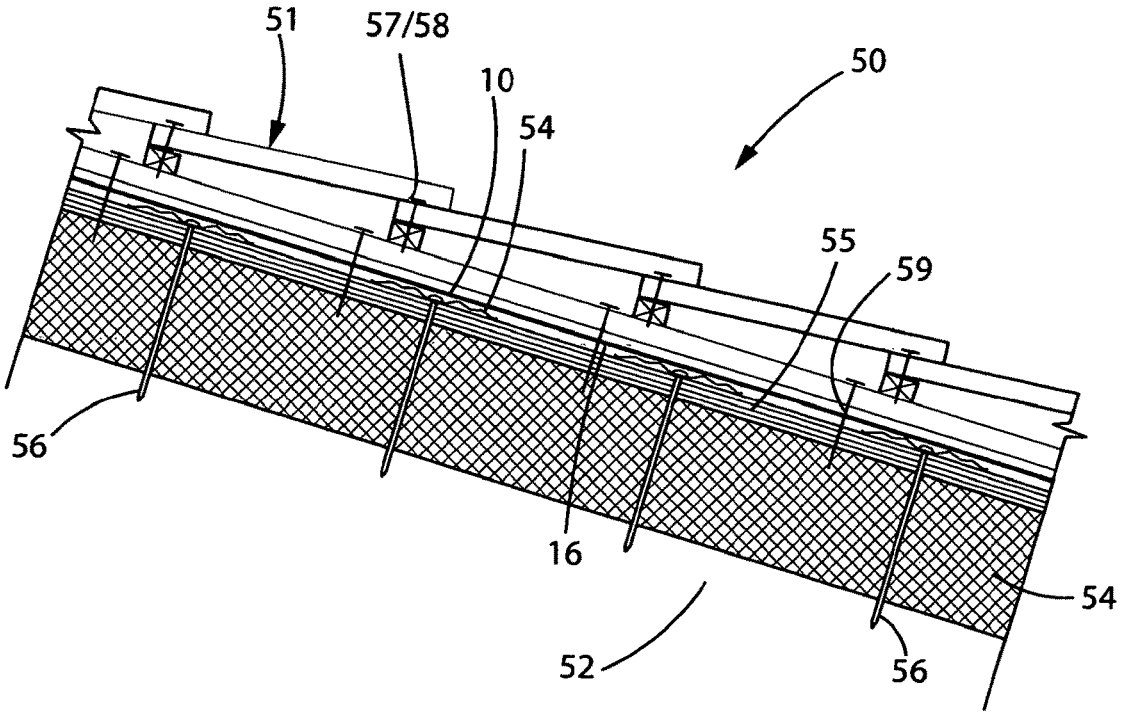
FIG. 3 is a schematic cross section view of a typical tile sloped roof system with the inventive underlayment used under a tile roof with battens and counter battens over a nail based rigid insulation.
Figure 4:
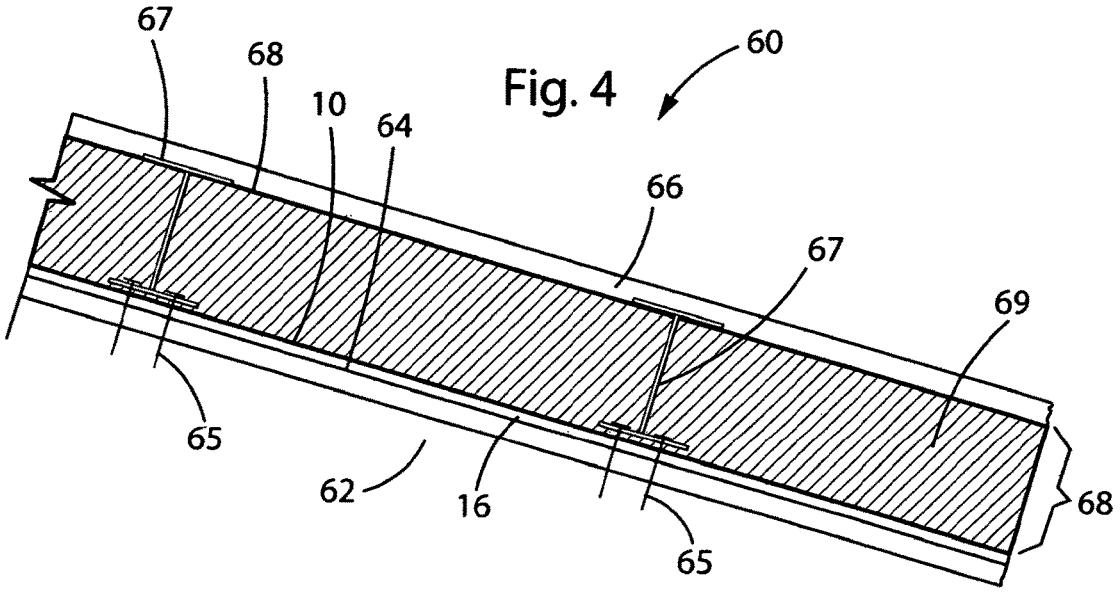
FIG. 4 is a schematic cross section view of sloped roof system with the inventive underlayment used under a metal roof placed over a filled rock wool insulation.

The present invention is directed toward a self-adhering water-resistant vapor permeable roofing underlayment membrane as shown in FIG. 1 which can be successfully used to cover sloped roofs greater than about 9.45°/2:12 in slope as is shown in FIGS. 2, 3 and 4. The self-adhering sloped roofing is a UV stabilized, vapor permeable, water resistant, air barrier and is also rot and tear resistant. With vapor permeance ranging from about 25 perms to about 45 perms, most preferably about Z 35 perms, the underlayment polyester membrane 10 allows the roof assembly to breathe or "dry out" as necessary during the seasonal changes. This helps to reduce or eliminate conditions that are conducive to mold, mildew, lumber distortion, insulation weight of the copolymer base coating solution is preferably added to the base coating for UV protection. This provides long term UV resistance allowing a roof 4 months UV exposure. A suitable copolymer base coating is manufactured by BASF SE Corporation and sold under the trademark ACRONAL® 4250.

The n-butyl acrylate polymer in the coating 14 ranges from 20 to 55% solids, with a pH ranging 7.7 to 8.0, and a preferred viscosity at 73° F. (cps) of 300 using a Brookfield RV viscometer Spindle #4 @ 100 rpm. The viscosity can effectively range from 100 to 500 depending on the percentage of solids. As previously noted, carbon black is also added to the copolymer to reduce tackiness, add strength and increase the UV effectiveness of the underlayment. The copolymer is foamed with a high speed dispersion mixer at 700 rpm with a 32% air injection and has entrained air bubbles so that it has a foam density ranging from about 50% to about 65% preferably from about 55% to about 60%. The coating 14 is applied to the polyester substrate 12.

The coating 14 is then heat cured after leaving the coating blade setting the foamed air bubbles in place in the copolymer providing the coating with permeability. The coating 14 copolymer ranges from about 30% to about 98% n-butyl acrylate.

A copolymer pressure sensitive adhesive 16 is run through a second foamer (high speed dispersion mixer) so that it is formed with encapsulated air bubbles and is then applied to the cured acrylate coating 14 or to a silicone slip sheet 18 at a thickness ranging from about 3 mils to about 10 mils, preferably about 4 mils to about 6 mils by a second blade coater, and heat cured as previously noted to fix the air bubbles in place. When the pressure sensitive adhesive is applied directly to the slip sheet 18, suitable pressure is applied to laminate the underlayment 12, deterioration and metal corrosion. The drying aspect is of utmost importance in energy efficiency with compact roof designs and non-vented attics.

The present roof underlayment 10 is constructed of permeable polyester sheet or membrane 12 of material ranging from about 180 mils to about 220 mils in thickness with a permeability ranging from about 65 perms to about 80 perms with a preferred permeability of about 75 perms. The polyester is pre-made and packaged in rolls which are unrolled at the manufacturing facility and coated at different stages in the facility. The sheet of polyester which forms the substrate 12 of the underlayment 10 can be multi ply or coated with an acrylic on one face. The opposing side of the sheet is coated with a permeable n-butyl acrylate copolymer coating 14 by a knife over roller in the first process stage.

The coating 14 is mixed prior to application on the polyester base layer and run through a foamer (high speed dispersion mixer) so that it formed with encapsulated air bubbles. These air bubbles are interconnected in the copolymer to form a vapor permeable coating ranging from about 80 mils to about 100 mils in thickness with a permeability ranging from about 30 perms to about 60 perms when it is cured. The coating 14 is coated on the polyester substrate 12 with a knife and roller in a wet application. The coating 14 is a wet foamed copolymer with the primary monopolymer being n-butyl acrylate mixed with another acrylate monopolymer.

Acrylates are the salts, esters and conjugate bases of acrylic acid and its derivatives. Acrylates contain vinyl groups; that is two carbon atoms double bonded to each other, directly attached to the carbonyl carbon.

Other polymers which can be mixed with the n-butyl acrylate are methyl acrylate, methyl methacrylate and methyl acrylic acid. Carbon black in the amount of approximately 1% by the acrylate coating 14, the pressure sensitive adhesive 16 and slip sheet 18. The completed underlayment 10 has a permeability ranging from about 25 perms to about 50 perms and a preferred range from about 30 perms to about 40 perms.

The present underlayment provides a fully self adhered product contrary to present products present in the industry with no need for a primer while remaining very permeable. The present underlayment eliminates mechanical fasteners which increases labor costs and creates a thermal loss along with possible leaks and discontinuous wind loading. The present underlayment has a UV resistance of at least 4 months and provides a walkable surface during construction.

The copolymer portion of the pressure sensitive adhesive (PSA) 16 has a backbone consisting of n-butyl acrylate, 2-ethylhexyl acrylate, and vinyl acetate. The structure of the backbone is shown in Table I below as follows:

TABLE I (Structure of PSA Polymer Backbone)

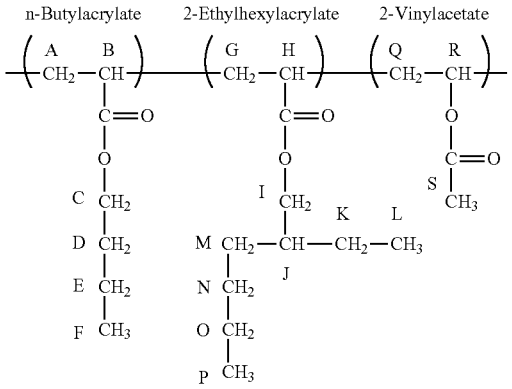

The adhesive fully bonds to the coating 14 for air tightness and ease of installation and requires no primer.

The pressure sensitive adhesive (PSA) is in the form of an acrylic solution. The polymeric portion of the PSA makes up from 90% to at least about 95% of the adhesive formulation and has a copolymer backbone of n-butyl acrylate (about 50% to about 60% by weight), 2-ethylhexyl acrylate (about 32% by weight) and vinyl acetate (about 7% by weight) forming a copolymer blend capable of bonding and cross-linking with the coating 14. Proper foaming of the adhesive is critical to good micropore formation. The aeration process includes high sheer mixing to entrain air in the mixed adhesive liquid solution. This is the same aeration process used for the coating. The self-adhering adhesive 16 is evenly applied on the n-butyl acrylate coating, cured and the micropores are formed and fixed throughout the PSA. The coating method used with the present invention for both the coating 14 and the PVA 16 was accomplished with a blade coater. This is a non-contact coating method and it does not crush or destroy the foam in the copolymer during coating. After application, the adhesive must be heated to lock-in the micropore formation. The adhesive in the present invention was reformulated by adding surfactants and water to the copolymer to control bubble size, bubble density, viscosity, and stability of the copolymer. The peel value of the adhesive is enhanced by the introduction of voids (air bubbles) and the addition of carbon black and a surfactant such as long chain alcohols create a stable inverse emulsion.

The acrylate polymer coating 14 does not require a slip sheet when applied. It is dry enough to be rolled onto itself. The pressure sensitive adhesive 16 is preferably applied to a silicone release film 17 and both are then laminated to the permeable polyester sheet and coating composite.

Microscopy of the modified adhesive surface was performed revealing a porous structure of the adhesive having a bubble density (number of pores) ranging from about 4000 pores in 1.0 $in^2$ to about 4600 pores in 1.0 $in^2$, preferably about 4400 pores in 1.0 $in^2$ with a majority of the pores, preferably about 80% to about 90% of the bubbles/pores having a size ranging from about 200 microns to about 300 microns. The pores formed are generally round and oval in shape and form a vapor pathway through the adhesive layer. The majority of the pores formed by the bubbles appear to be distributed evenly across the surface penetrating through the adhesive layer when the polymer mixture is heat treated to set the pores in the adhesive. Preferably, the density of the foamed adhesive should fall between about 0.65 and about 0.75 after aeration.

The adhesive copolymer which was manufactured and is shown in Table I has a polymeric portion ranging from 90% to 98%, preferably 95% with about 50% by weight to about 60% by weight, preferably about 50% by weight of an n-butyl acetate. The copolymer was mixed with a first solvent-free, surfactant-based wetting agent, preferably ranging from about 4% by weight to about 6% by weight, and most preferably about 5% by weight to provide emulsification and bubble size; and a second surfactant such as a foaming agent ranging from about 1.5% by weight to about 2.0% by weight, and preferably about 1.7% by weight to provide foam formation. A polymeric based thickener was added to the mixture in a range from about 0.2% by weight to about 0.4% by weight, preferably about 0.30% by weight. The adhesive copolymer composition was added to water ranging from about 40% by weight to about 50% by weight, preferably about 43% by weight to about 45% by weight and mixed in a high speed dispersion mixer at 500 rpm to form uniform bubbles in the mixture and fed into a coater feeder as previously described. The foamed adhesive was coated onto the cured porous n-butyl acrylate coating and heat cured to form the pores in place in the copolymer.

For industry testing standards, the present underlayment 10 will support a water column of twenty four (24) inches of water for forty eight (48) hours. The inventive underlayment 10 has very high fire resistant properties with low smoke development and low flame spread.

Construction of one embodiment of a sloped commercial roof 40 using the inventive underlayment membrane is shown in FIG. 2. As shown in FIG. 2, a profiled metal roof deck 42 has a rigid polyiso insulation sheet 43 fastened to the roof deck 42 by long length screws 44, staples or other mechanical fasteners. The inventive underlayment membrane 10 is mounted on the rigid polyiso insulation 43 and secured thereto by the pressure sensitive adhesive 16 of the membrane. The permeable coated underlayment membrane 10 is covered by a standing seam metal roof 46 and is held in place by associated metal clips 47 as is known in the industry.

Construction of yet another embodiment of a sloped commercial roof 50 is shown in FIG. 3. As shown in the FIG. 3, a profiled metal roof deck 52 has a mechanically attached nail base of plywood 55 and rigid polyiso insulation member 54 fastened to the roof deck 52 by long length screws 56 or other mechanical fasteners. The inventive permeable underlayment membrane 10 is mounted on the plywood sheathing 55 and secured thereto by the pressure sensitive adhesive 16. Battens 57 and counter battens 58 are mechanically attached by nails 59 to the rigid polyiso insulation 54 and plywood 55. The tile roof panels 60 are fastened to the counter battens.

Construction of still another embodiment of a sloped commercial roof 70 using the inventive underlayment membrane is shown in FIG. 4. As shown in this Figure, a profiled metal roof deck 62 has a ½ inch mechanically attached thermal barrier board 64 fastened to the roof deck 62 by nails 65, staples or other mechanical fasteners. The permeable membrane underlayment 10 is mounted on the barrier board 64 and secured thereto by the pressure sensitive adhesive 16 of the membrane 10. A structural standing seam metal roof 66 and associated clips 67 are secured by mechanical fasteners to the metal roof deck 62 forming a cavity 68 which is filled with rock wool insulation 69.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A method for constructing a roof, the method comprising:

mounting an underlayment that is an air barrier and self-adhering, vapor-permeable, water-resistive, and UV-resistant, to a first component of a roof, the underlayment comprising:

a sheet of permeable plastic having a surface;

a foamed permeable copolymer coating attached to the permeable plastic's surface, wherein the foamed permeable copolymer coating includes a primary monomer of n-butyl acrylate, wherein the foamed permeable copolymer is secured to the sheet of permeable plastic and has a density that ranges from 50% to 65% of the permeable copolymer coating's density before the permeable copolymer coating is foamed; and a permeable pressure-sensitive adhesive secured to the foamed permeable copolymer coating; and mounting a second roof component, that shields the roof's first component and the underlayment from the elements in the outside environment, to the first roof component such that the underlayment lies between the first and second roof components.

2. The method of claim 1 wherein the first component of the roof includes a roof deck.

3. The method of claim 1 wherein the first component of the roof includes insulation and the underlayment is mounted onto the insulation.

4. The method of claim 1 wherein the first component of the roof includes a thermal barrier board and the underlayment is mounted onto the thermal barrier board.

5. The method of claim 1 wherein the underlayment's permeable pressure-sensitive adhesive helps secure the underlayment to the roof's first component.

6. The method of claim 1 wherein the second component of the roof includes a standing seam metal roof.

7. The method of claim 1 wherein the second component of the roof includes insulation and the underlayment contacts the insulation.

8. The method of claim 1 wherein the second component of the roof includes battens and the underlayment contacts the battens.

9. The method of claim 1 wherein the roof being constructed is a new roof that was not previously constructed.

10. The method of claim 1 wherein the roof constructed is a commercial roof.

11. The method of claim 1 wherein the underlayment has a permeability in the range of from about 25 perms to about 45 perms.

* * * * *